US009845220B2

(12) United States Patent
Burchert et al.

(10) Patent No.: US 9,845,220 B2
(45) Date of Patent: Dec. 19, 2017

(54) METHOD AND WINDING STATION FOR IMPROVING A WINDING PROCESS OF A TEXTILE MACHINE

(71) Applicant: Maschinenfabrik Rieter AG, Winterthur (CH)

(72) Inventors: Mathias Burchert, Ostfildern (DE); Volker Jehle, Öhningen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 47 days.

(21) Appl. No.: 14/897,408

(22) PCT Filed: Jun. 10, 2014

(86) PCT No.: PCT/EP2014/062047
§ 371 (c)(1),
(2) Date: Dec. 10, 2015

(87) PCT Pub. No.: WO2014/198733
PCT Pub. Date: Dec. 18, 2014

(65) Prior Publication Data

US 2016/0145067 A1 May 26, 2016

(30) Foreign Application Priority Data

Jun. 10, 2013 (DE) ..... 10 2013 106 016

(51) Int. Cl.
*B65H 63/06* (2006.01)
*B65H 63/08* (2006.01)
(Continued)

(52) U.S. Cl.
CPC ..... *B65H 63/06* (2013.01); *B65H 61/005* (2013.01); *B65H 63/064* (2013.01);
(Continued)

(58) Field of Classification Search
CPC .. B65H 63/064; B65H 63/065; B65H 63/082; B65H 69/061; B65H 61/005
See application file for complete search history.

(56) References Cited

U.S. PATENT DOCUMENTS 5,676,329 A 10/1997 Bertoli et al.

FOREIGN PATENT DOCUMENTS

CH 699599 A1 3/2010
CH WO 2012051730 A1 * 4/2012 ..... B65H 63/064
(Continued)

OTHER PUBLICATIONS

Machine translation of EP 1 249 422 A2, Oct. 16, 2002.*
Machine translation of CH 699 599 A1, Mar. 31, 2010.*
PCT International Search Report, dated Sep. 25, 2014.

*Primary Examiner* — William E Dondero
(74) *Attorney, Agent, or Firm* — Dority & Manning, P.A.

(57) ABSTRACT

A method improves a winding process of a textile machine and a winding station of a textile machine having a machine controller (11), a yarn sensor (4), a yarn quality monitor, in particular a yarn clearer (5), and a yarn connecting device, in particular a splicing device (3). A yarn (1) is wound onto a bobbin (2). The yarn (1) is analyzed with regard to its length, quality, and/or speed, and is cut if necessary in order to clear a quality defect and two yarn ends are connected to one another by means of the yarn connecting device after the quality defect has been removed. The yarn (1) is analyzed with regard to foreign material, yarn speed, and/or yarn length by means of a capacitive yarn sensor (4), and is analyzed with regard to the yarn body and the yarn characteristic by means of an optical yarn quality monitor. The yarn (1) is subsequently optionally cleared. Data of the capacitive yarn sensor (4) with regard to the foreign material and/or the yarn speed is provided to the yarn quality monitor, in
(Continued)

particular the yarn clearer (5), and with regard to the yarn length and/or the yarn speed are provided to the machine controller (11).

14 Claims, 1 Drawing Sheet

(51) Int. Cl.
*B65H 69/00* (2006.01)
*B65H 61/00* (2006.01)
*B65H 69/06* (2006.01)

(52) U.S. Cl.
CPC ..... *B65H 63/065* (2013.01); *B65H 63/082* (2013.01); *B65H 69/00* (2013.01); *B65H 69/06* (2013.01); *B65H 69/061* (2013.01); *B65H 2701/31* (2013.01)

(56) References Cited

FOREIGN PATENT DOCUMENTS

| | | | |
|---|---|---|---|
| EP | 1 249 422 | A2 | 10/2002 |
| EP | 1 795 478 | A1 | 6/2007 |

* cited by examiner

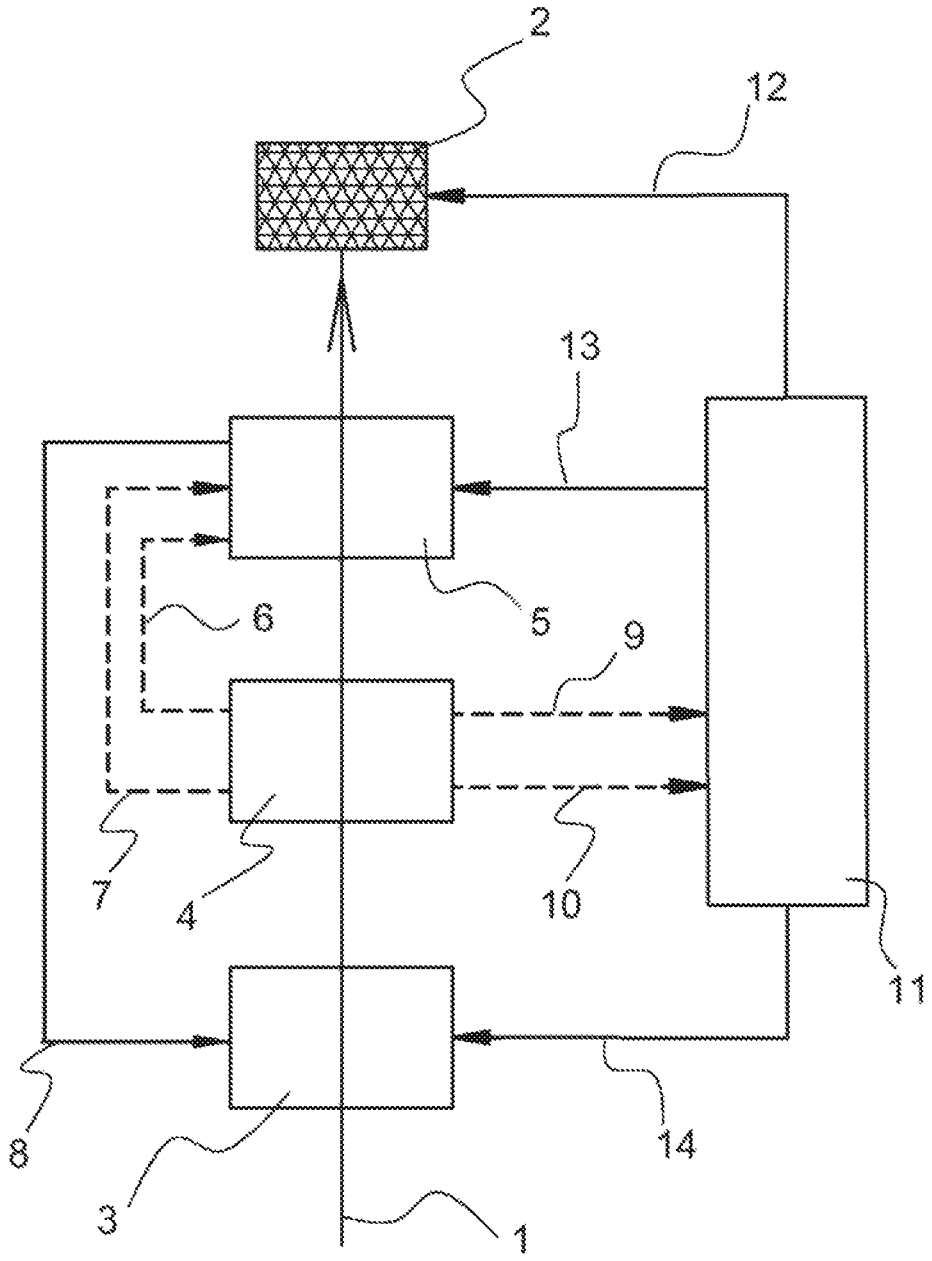
2
12
13
5
6
9
7
4
10
11
8
14
3
1

METHOD AND WINDING STATION FOR IMPROVING A WINDING PROCESS OF A TEXTILE MACHINE

FIELD OF THE INVENTION

The present invention relates to a method for improving a winding process of a textile machine comprising a machine controller, a yarn sensor, a yarn quality monitor, in particular a yarn clearer, and a yarn connecting device, in particular a splicing device. A yarn is wound onto a bobbin and the yarn is analyzed with regard to its length, quality, and/or speed, and the yarn is cut if necessary in order to clear a quality defect, in particular by means of a yarn clearer. Two yarn ends are connected to one another by means of the yarn connecting device after the quality defect has been removed.

BACKGROUND OF THE INVENTION

Important components of the winding process, for example yarn clearers, splicers, or speed sensors, are developed and marketed by various independent suppliers. These individual components operate largely independently, and either evaluate their determined data themselves or send the data to a central machine unit. From the central machine unit, the data is, in turn, sent to the winding station, where it is further processed either by the same component or by another component of the winding process. However, logical linking of the individual components does not take place.

SUMMARY OF THE INVENTION

An object of the present invention is to link several important components of the winding process to one another in such a way that information is available to all relevant stations and can be utilized for optimizing the system. Additional objects and advantages of the invention will be set forth in part in the following description, or may be learned through practice of the invention.

The objects are achieved with a method and a winding station as described and claimed herein.

For improving a winding process of a textile machine, for example a winding machine or a spinning machine, such a machine has a machine controller, a yarn sensor, a yarn quality monitor, in particular a yarn clearer, and a yarn connecting device, in particular a splicing device.

A machine controller is understood to mean a controller which, as a central controller, controls the entire machine having multiple work stations at which the winding process takes place for multiple yarns, or, as a section controller, controls individual work stations, for example combined in a section, or, as a work station controller, controls each individual work station. In addition, a plurality of these controllers, which operate individually or in cooperation, are possible.

The yarn speed or a yarn length derived therefrom may be determined by means of the yarn sensor. The yarn sensor may also be capable of determining foreign material that is present in the yarn, for example polypropylene fibers.

The yarn quality monitor may be a yarn clearer, for example. The quality of the yarn to be wound with regard to its yarn body and its yarn characteristic are determined with the yarn quality monitor. For example, thick and thin points, the hairiness, the twist, the surface of the yarn, and the effects of these yarn properties on a woven or knitted fabric, etc., may thus be determined.

A yarn connecting device is, for example, a splicing device which can connect two yarn ends to one another. Such splicing devices are typically used in winding machines or in some air spinning machines. In particular when the method according to the invention is used in an open end spinning machine or likewise in some air spinning machines, the yarn connecting device brings a yarn end of a yarn that is already spun into connection with a newly spun yarn or with fibers to be spun. The second yarn end has been spun immediately prior to the yarn connection or in conjunction with the yarn connection. The term "second yarn end" is not limited to a yarn that is already completely spun, and its yarn end.

In the winding process, a yarn is wound onto a bobbin. The yarn is analyzed with regard to its length, quality, and/or speed. If a quality defect is determined, the yarn is cut for clearing, i.e., for removing the defective yarn piece. This cutting of the yarn takes place, for example, by means of the yarn quality monitoring device, in particular the yarn clearer. After the quality defect is removed, the two yarn ends—as described for a winding machine, for example, the two yarn ends of the completed yarns, or for a spinning device, the yarn end of the already spun yarn with the newly attached yarn end—are connected to one another by means of the yarn connecting device.

According to the invention, the yarn is analyzed by means of a capacitive yarn sensor. The analysis by the capacitive yarn sensor takes place with regard to foreign material, yarn speed, and/or yarn length. While the yarn sensor operates according to the capacitive measuring principle, the yarn quality monitoring takes place according to the optical principle. In particular, an optical yarn clearer analyzes the yarn with regard to the yarn body and the yarn characteristic. When one or both of these analyses determine(s) a yarn defect, the yarn is optionally cleared, in particular when these defects are above a permissible tolerance range.

To be able to optimally link the components of the winding process to one another, according to the invention, it is provided that the data of the capacitive yarn sensor with regard to the foreign material and/or the yarn speed are provided to the yarn quality monitor, in particular the yarn clearer. The further data of the capacitive yarn sensor, namely, the yarn length and/or also the yarn speed, are provided to the machine controller, in particular a central controller, section controller, and/or work station controller. The capacitive yarn sensor is the central component, whose data is provided to the relevant station, namely, on the one hand for the yarn quality monitor and on the other hand for the machine controller. Due to this linkage of the capacitive yarn sensor, yarn quality monitor or yarn quality monitoring device, and machine controller, the available information concerning quality, productivity, and accuracy of the winding process are optimally utilized, and the winding process is thereby greatly improved.

In one advantageous embodiment of the method according to the invention, the quality of the yarn connection is evaluated by means of the yarn quality monitor, taking into account the data of the yarn sensor concerning yarn speed. In particular during the yarn connection or the yarn attachment, the yarn does not move at the customary delivery speed, but instead either has a lower delivery speed or is in an acceleration phase. As a result, the length of a yarn defect can be determined only imprecisely, since the yarn speed is not exactly known. Due to the linkage of the information of the capacitive yarn sensor with the optical yarn quality monitoring device, the quality of the yarn connection may thus be determined much better and with greater accuracy, since the length of a possible yarn defect may be precisely computed.

According to one advantageous embodiment of the invention, when the quality of the yarn is evaluated by means of the yarn quality monitor, taking into account the data of the yarn sensor with regard to the yarn speed and/or the presence of a foreign material, it is also thus possible to determine the yarn quality much more accurately. Thus, for example, the length of the foreign material is precisely determinable by the presence of information concerning the instantaneous yarn speed. In addition, for other yarn defects, for example diameter differences of the yarn, in which the length of the defect or the distance between successive defects is important, the information concerning the yarn speed from the capacitive yarn sensor may allow a more accurate evaluation of the yarn defect.

According to the invention, the information concerning the yarn speed and the foreign fibers is transmitted directly from the capacitive yarn sensor to the optical yarn clearer or the yarn quality monitoring device. The yarn length, which is to be determined from the yarn speed, is relayed by the capacitive yarn sensor directly to the machine controller, or is computed in the machine controller based on the information concerning the yarn speed. With the determined yarn length, it may be ascertained, for example, whether the planned yarn length on the bobbin has been reached, and whether the winding process for this bobbin should therefore be discontinued.

If the quality of multiple yarn connections, determined by means of the yarn quality monitor, is used for the optimized setting of the parameters of the yarn connecting device, in particular the splicing device, according to one advantageous embodiment of the invention a continuous improvement in the yarn connections is achieved. Examples of parameters that may be set in an optimized manner for a splicing device, for example, include the length of the yarn ends to be prepared, or the duration for which the air or the fluid of the splicing device acts on the yarn end for preparing the yarn ends. During the thread attachment, such parameters may also be the length of the yarn end to be prepared, or the duration of the preparation or the duration of the connection to the newly supplied fibers, as well as the time and acceleration of the yarn take-off, and may be set in an optimized manner using the data from the yarn sensor.

The parameters of the yarn connecting device may also advantageously be automatically set using the quality data of the yarn quality monitor. This means that, similarly as for the advantageous embodiment described above, the parameters and thus the yarn connection are optimized; in this embodiment, instead of an evaluation of the quality of multiple yarn connections, the quality data of the yarn quality monitor are directly used.

The yarn connecting device, the yarn sensor, and the yarn quality monitor are preferably directly or indirectly connected to one another in terms of data. In particular for setting the parameters of the yarn connecting device, the yarn quality monitoring device is directly connected to the yarn connecting device in terms of data. Likewise, a direct connection in terms of data between the yarn sensor and the quality monitoring device is advantageous with regard to the yarn speed and the recognition of foreign fibers. With regard to the transmission of the yarn length and the response, for example for cutting the thread, a direct connection in terms of data between the capacitive yarn sensor and the optical yarn clearer is provided via the machine controller. In particular, when the response times are not of extreme importance, the indirect connection is frequently advantageous, since the load on the computing units for the quality monitoring and the yarn sensor as well as the yarn connecting device are thus reduced.

The yarn length determined by means of the yarn sensor is advantageously used for winding the bobbin with a predetermined setpoint yarn length. After reaching this predetermined setpoint yarn length, the yarn is cut, for example by the yarn clearer. It is thus advantageously achieved that bobbins having very low tolerances with regard to their wound-up yarn lengths may be produced. The accuracy of the winding process is thus improved, since waste in the subsequent processes is reduced.

In one particularly advantageous embodiment of the invention, if a yarn tensioning device is associated with the yarn, wherein the yarn may be tensioned, in particular braked, as a function of the data of the yarn sensor, controlling the thread tension as a function of the yarn speed, the bobbins, etc., is possible. The controlled or regulated yarn braking may bring about improved winding of the yarn with greater uniformity and fewer yarn breaks.

If the data of the yarn sensor and/or of the yarn quality monitor for evaluating the quality of the bobbin or the quality or productivity of the winding station are stored, back-tracing, for example, is possible in order to detect defective winding stations. In addition, a division of the produced bobbins according to certain quality criteria, for example the number of splice connections, IPI, hairiness, etc., in a database and/or directly on the bobbin, for example using an RFID chip or barcode, is possible.

It is particularly advantageous when the yarn body and/or the yarn characteristic is/are analyzed by the optical quality monitor, in particular in the optical yarn clearer, for example with regard to thick and thin points, hairiness, and/or twist. Thus, for example, the quality of the splice connection may also be evaluated in consideration of the yarn, weave, or knit characteristics. The yarn speed is likewise taken into account for this purpose.

It is clarified here once again that the connection of two yarn ends also refers to the connection of a yarn end to a fiber composite which has been spun immediately beforehand. After the yarn is cut, a new yarn is spun onto a yarn end of the old yarn instead of connecting one old yarn end to another old yarn end.

A winding station according to the invention of a textile machine comprises a machine controller, a yarn sensor, a yarn quality monitoring device, in particular a yarn clearer, and a yarn connecting device, in particular a splicing device. The winding station is used for winding a yarn onto a bobbin. The wound-up yarn is analyzed with regard to its length, quality, and/or speed. If a quality defect of the yarn is determined, it is cleared, in particular by means of a yarn clearer, which cuts the yarn. The yarn may also be cut using a separate yarn cutting device or by changing the rotational speeds of successive units, as the result of which the yarn breaks.

After the quality defect is removed, two yarn ends are connected to one another by means of the yarn connecting device; this may involve two yarn ends of the old yarn, or a yarn end of the old yarn and a yarn end of a newly spun yarn.

According to the invention, the winding station has an optical yarn quality monitoring device, in particular an optical yarn clearer, and a machine controller, in particular a central controller, section controller, and/or work station controller. The yarn quality monitoring device and the machine controller are directly or indirectly connected in terms of data to a capacitive yarn sensor. The method according to the invention described above may be carried out in this way.

In one particularly advantageous embodiment, the optical yarn clearer may determine yarn body and the yarn characteristic, for example twist, hairiness, surface, diameter structure, weave, or knit defect, etc., by means of a laser. The reference data for determining whether the yarn is in the setpoint range or outside the setpoint range including a certain allowed tolerance may be provided by an application database.

The yarn quality monitoring device, in particular the optical yarn clearer, is advantageously connected in terms of data to the yarn connecting device. This connection may be established directly, so that a very rapid response by the yarn connecting device may take place. However, an indirect connection of the yarn quality monitoring device to the yarn connecting device which is directed via the machine controller is also possible. This is advantageous, for example, when continuous setting of the yarn connecting device on this winding station and/or further winding stations of the textile machine is to take place.

In one particularly advantageous embodiment of the invention, the capacitive yarn sensor is connected in terms of data to the machine controller and to the yarn quality monitoring device. Here as well, a direct connection or an indirect connection to the sensor of the yarn quality monitoring device via the machine controller may take place.

The basic concept of the present invention is that at least three components of the winding position are integrated or linked with one another. The capacitive yarn sensor is a central component of the system. This sensor supplies data concerning:

yarn quality: foreign fibers in the yarn
→recipient is the yarn clearer
yarn speed
→recipient is the yarn clearer
yarn length: precise measurement of the yarn length for each bobbin
→recipient is the machine controller The optical yarn clearer assesses, in particular by means of laser technology, the yarn body and the yarn characteristic such as twist, hairiness, surface, diameter structure, weave, knit defects, etc. The reference data may be provided by an application database.

The length classification of the recognized defective points in the area of the nonstationary winding phases (winding start) is determined, taking the yarn speed into account. Quality defects which may be attributed to foreign fibers (PP, for example) are recognized by the yarn sensor and cut out by the yarn clearer, for example. In addition, the yarn clearer evaluates the quality of the yarn connection with consideration of the yarn, weave, and knit characteristics. The yarn speed is likewise taken into account for this purpose. Optimization software determines, based on the quality data of the yarn connections, the optimal yarn connection parameters, which are transmitted to the controller of the yarn connecting device.

The yarn connecting device is optimized within defined limits by the connection to the yarn clearer. The yarn, which runs from the yarn connecting device to the yarn clearer, closes the control loop. Further components which could be integrated into the system include the following, for example:

thread tension devices (regulated thread brakes) with control of the thread tension as a function of the yarn speed, bobbin size, etc.
storage of quality data, such as splice connections, IPI, hairiness in a database or in an RFID chip in the bobbin, to ensure back-tracing.

BRIEF DESCRIPTION OF THE DRAWING

Further advantages of the invention are described in the following exemplary embodiments. The single FIGURE shows:

FIGURE a schematic illustration of the present invention.

DETAILED DESCRIPTION

Reference will now be made to the embodiments of the invention, one or more examples of which are shown in the drawings. Each embodiment is provided by way of explanation of the invention, and not as a limitation of the invention. For example features illustrated or described as part of the one embodiment can be combined with another embodiment to yield still another embodiment. It is intended that the present invention include these and other modifications and variations to the embodiments described herein.

The single FIGURE shows a schematic illustration of the present invention. A yarn 1 is accordingly wound onto a bobbin 2. The yarn 1 runs in the direction of the arrow along a yarn connecting device, in the present case a splicing device 3, a capacitive yarn sensor 4, and a yarn quality monitoring device, in the present case an optical yarn clearer 5.

The yarn sensor 4 occupies a central position with respect to the data transmission. In the yarn sensor 4, which operates according to the capacitive measuring principle, the yarn 1 is analyzed with regard to foreign fibers, for example made of polypropylene, contained therein, and the yarn speed. The information concerning foreign fibers which have been recognized in the yarn 1 and concerning the speed of the yarn 1 is transmitted as recognized foreign fibers 6 and yarn speed 7 to the yarn clearer 5. In the present exemplary embodiment, the yarn clearer 5 utilizes this data via the data line 8 to be able to set the parameters of the splicing device 3. In this regard, for example parameters for preparing the yarn ends or concerning the length of the overlapping yarn ends may be set.

According to the present exemplary embodiment, the yarn sensor 4 likewise transmits data concerning the yarn speed 9 and data concerning the yarn length 10 to a machine controller 11. The machine controller 11 may be provided only for the winding station illustrated here. However, it is also possible for the machine controller 11 to be responsible for multiple adjoining winding stations, for example within a section. However, the machine controller 11 may also be a central controller which processes data for all winding stations of the textile machine. The machine controller 11 evaluates the data concerning the yarn speed 9 and the data concerning the yarn length 10 of the capacitive yarn sensor 4, and transmits the data concerning the yarn length 10 and/or yarn speed 9 to the bobbin 2 or its bobbin device via a data line 12, and to the optical yarn clearer 5 via a data line 13. For setting the splice parameters, starting from the information from the yarn sensor 4, the machine controller 11 is connected to the splicing device 3 via the data line 14.

It is noted that the present invention does not necessarily require all data streams, or that of course even further data streams may be present, for example between the yarn clearer 5 and the machine controller 11. It is important that the capacitive yarn sensor 4 represents the central element for assessing the yarn 1 at the winding station. In particular, the yarn clearer 5 is directly, and the splicing device 3 is indirectly, supplied with data via the yarn sensor 4 in order to optimize their functioning, methods carried out, or settings. In addition, further settings and optimizations at the bobbin 2 or its bobbin device which supports and drives the bobbin 2 or changes the yarn in the bobbin 2, and/or at the yarn clearer 5 and/or at the splicing device 3, may indirectly take place via the data of the yarn sensor 4 and the machine controller 11.

The present invention is not limited to the exemplary embodiment illustrated. The evaluation and control of fewer options than described here, or some other combination of these data evaluations, are possible at all times within the scope of the patent claims. Of course, the splicing device 3, the yarn sensor 4, and/or the yarn clearer 5 may also be accommodated in a single housing. The data lines 8, 12, and 13 as well as the transmission of the data 6, 7, 9, 10 may be designed as, or by means of, lines and/or wirelessly, for example in a bus system.

Modifications and variations can be made to the embodiments illustrated or described herein without departing from the scope and spirit of the invention as set forth in the appended claims.

LIST OF REFERENCE NUMERALS

1 Yarn
2 Bobbin
3 Splicing device
4 Capacitive yarn sensor
5 Optical yarn clearer
6 Data concerning foreign fiber recognition
7 Data concerning yarn speed
8 Data line
9 Data concerning yarn speed
10 Data concerning yarn length
11 Machine controller
12 Data line
13 Data line
14 Data line

The invention claimed is:

1. A method for a winding process of a textile machine wherein a yarn is wound onto a bobbin, the textile machine including:
- a machine controller;
- a yarn sensor configured as a capacitive yarn sensor;
- a yarn quality monitor configured as an optical yarn clearer; and
- a yarn connecting device configured as a splicing device, the method comprising:
- analyzing the yarn with regard to one or more of length, quality, or speed;
- cutting the yarn with the optical yarn clearer when necessary to clear a quality defect;
- connecting two yarn ends to one another with the splicing device after the quality defect has been removed;
- wherein the analyzing step includes analyzing with regard to foreign material, yarn speed, and yarn length with the capacitive yarn sensor, and analyzing with regard to yarn body and characteristic with the optical yarn quality clearer;
- wherein data of the capacitive yarn sensor with regard to the foreign material in the yarn and yarn speed is provided to the optical yarn clearer, and
- wherein data of the capacitive yarn sensor with regard to the yarn length and the yarn speed is provided to the machine controller.

2. The method according to claim 1, wherein the quality of the yarn connection is evaluated by the yarn quality monitor taking into account the data of the capacitive yarn sensor concerning yarn speed.

3. The method according to claim 2, wherein the quality of the yarn is evaluated by the yarn quality monitor additionally taking into account the data of the capacitive yarn sensor concerning foreign material in the yarn.

4. The method according to claim 3, wherein the yarn quality monitor determines quality of multiple yarn connections used for the optimized setting of the parameters of the yarn connecting device.

5. The method according to claim 4, wherein the parameters of the yarn connecting device for a splicing operation are automatically set using the quality data of the yarn quality monitor.

6. The method according to claim 1, wherein the yarn connecting device, yarn sensor, and yarn quality monitor are directly or indirectly connected to one another in terms of data transmission.

7. The method according to claim 1, wherein yarn length determined by the capacitive yarn sensor is used for winding the bobbin with a predetermined setpoint yarn length, and the yarn is cut after the setpoint yarn length is reached.

8. The method according to claim 1, wherein a yarn tensioning device is used to tension the yarn as a function of the data from the capacitive yarn sensor.

9. The method according to claim 1, wherein data from the capacitive yarn sensor and the optical yarn clearer is stored.

10. The method according to claim 1, wherein the yarn body and the yarn characteristics are analyzed by the optical yarn clearer with regard to thick and thin points, hairiness, or twist.

11. The method according to claim 1, wherein the step of connecting two yarn ends to one another with the splicing device includes, after the yarn is cut, spinning a new yarn onto a yarn end.

12. A winding station of a textile machine for winding a yarn onto a bobbin in accordance with the method of claim 1, comprising:
- a machine controller;
- a capacitive yarn sensor;
- an optical yarn clearer;
- a splicing device,
- wherein the optical yarn clearer and the machine controller are directly or indirectly connected in terms of data transmission to the capacitive yarn sensor.

13. The winding station according to claim 12, wherein the optical yarn clearer is connected in terms of data transmission to the splicing device via the machine controller.

14. The winding station according to claim 13, wherein the capacitive yarn sensor is connected in terms of data transmission to the machine controller and to the optical yarn clearer.

* * * * *